US007513115B2

(12) United States Patent
Stuttaford

(10) Patent No.: US 7,513,115 B2
(45) Date of Patent: Apr. 7, 2009

(54) FLASHBACK SUPPRESSION SYSTEM FOR A GAS TURBINE COMBUSTOR

(75) Inventor: Peter John Stuttaford, Jupiter, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 513 days.

(21) Appl. No.: 10/908,682

(22) Filed: May 23, 2005

(65) Prior Publication Data

US 2006/0260316 A1 Nov. 23, 2006

(51) Int. Cl.
*F02C 1/00* (2006.01)
*F02G 3/00* (2006.01)
*F23D 14/82* (2006.01)

(52) U.S. Cl. ..... 60/737; 60/743; 431/346

(58) Field of Classification Search ..... 60/737, 60/733, 39.11, 39.461, 804, 743, 742, 746; 431/2, 3, 8, 346

See application file for complete search history.

(56) References Cited

U.S. PATENT DOCUMENTS 4,731,989 A * 3/1988 Furuya et al. ..... 60/775
5,251,447 A * 10/1993 Joshi et al. ..... 60/737
5,758,587 A 6/1998 Buchner et al.
6,056,538 A * 5/2000 Buchner et al. ..... 431/115
6,571,559 B1 6/2003 Fortuna et al.

* cited by examiner

*Primary Examiner*—William H Rodríguez
*Assistant Examiner*—Gerald L Sung

(57) ABSTRACT

A gas turbine combustor having improved flashback margin is disclosed. Multiple embodiments of the present invention are disclosed including combustors having a single premix chamber as well as multiple premix chambers. Flashback margin is increased for the combustor by incorporating a means for introducing an inert gas, such as nitrogen, into the premix chamber(s) at the region proximate the boundary layer to purge the boundary layer of combustible mixture, thereby ensuring that no combustion reaction occurs in the boundary layer.

6 Claims, 3 Drawing Sheets

FLASHBACK SUPPRESSION SYSTEM FOR A GAS TURBINE COMBUSTOR

BACKGROUND OF THE INVENTION

The present invention relates in general to gas turbine combustors and more specifically to premixed combustors having improved flashback margin.

In a combustion system for a gas turbine, fuel and compressed air are mixed together and ignited to produce hot combustion gases that drive a turbine and produce thrust or drive a generator for producing electricity. In an effort to reduce pollution levels, government agencies have introduced new regulations requiring gas turbine engines to reduce emitted levels of emissions, including carbon monoxide and oxides of nitrogen (NOx). A common type of combustion, employed to comply with these new emissions requirements, is premix combustion, where fuel and compressed air are mixed together prior to ignition to form as homogeneous a mixture as possible and burning this mixture to produce lower emissions. While premixing fuel and compressed air prior to combustion has its advantages in terms of emissions, it also has certain disadvantages such as combustion instabilities. More specifically, premix combustion stability issues of concern include combustion dynamics and flashbacks.

In order to achieve the lowest possible emissions through premixed combustion, without the use of a catalyst, it is desirable to provide a fuel-lean mixture to the combustor. However, the richer the fuel content in a combustor, the more stable the flame and combustion process. Therefore, fuel-lean mixtures tend to be more unstable given the lesser fuel content for a given amount of air. As a result, when fuel-lean mixtures are burned they tend to produce greater pressure fluctuations due to the unstable flame.

Another area of concern with gas turbine combustors and their stability is with respect to flashback and the migration of a flame upstream from the desired location. Flashback typically occurs when the flame migrates upstream from the combustion chamber through the combustor boundary layer, or the location along the combustor walls where flow velocity is the lowest, to the premixing sections of the combustor. A flame can move up through the low flow velocity region in the boundary layer if pressure fluctuations occurring within the combustor allow the flamefront to move upstream and a combustible mixture is present in the boundary layer to sustain the flame. In operation, if a combustor flashes back, the flashback can cause significant damage to combustor hardware if going undetected, possibly requiring premature replacement or repair. Furthermore, a flashback can affect engine performance by unexpectedly reducing power output. Flashback margin is typically provided by ensuring the bulk fuel/air velocity in the premixer substantially exceeds the flame speed of the fuel/air mixture, thus ensuring that the flame cannot propagate upstream into the premix chamber. However, for high flame speed fuels, establishing flashback margin, can require extremely high velocities, which in turn results in high combustion pressure drop and hence deterioration of engine efficiency.

In order to provide a more stable premix combustion process over the prior art, while also obtaining the lowest emissions possible, it is necessary to provide a means for purging the boundary layer of the combustor, such that no combustion reaction can take place in the boundary layer.

SUMMARY OF THE INVENTION

A gas turbine combustor having increased flashback margin is disclosed. The gas turbine combustor comprises a premix chamber having a first generally annular wall, a combustion chamber having a second generally annular wall with the combustion chamber being in fluid communication with the premix chamber. At least one fuel nozzle is positioned to inject a fuel into the premix chamber to form a mixture with compressed air from an air source, such as a gas turbine compressor. The fuel and air mixture is ignited in the combustion chamber to drive the engines' turbine and provide thrust or further mechanical output in the form of shaft power for driving a generator for producing electricity. The combustor also has areas of lower velocity fuel and air mixture that are present in the combustor boundary layer, which is proximate the first and second generally annular walls. To prevent flashback of the flame from the combustion chamber to the premixing chamber via these lower velocity regions, the combustor of the present invention incorporates a means for introducing an inert gas, such as nitrogen, to the combustor boundary layer. Purging the boundary layer with an inert gas will prevent a combustible reaction from occurring and being sustained in the boundary layer should a flashback occur. Purging the boundary layer with an inert gas will have little impact on the combustor or engine performance while simultaneously improving flashback margin.

DETAILED DESCRIPTION OF THE PREFERRED EMBODIMENT

Figure 1:
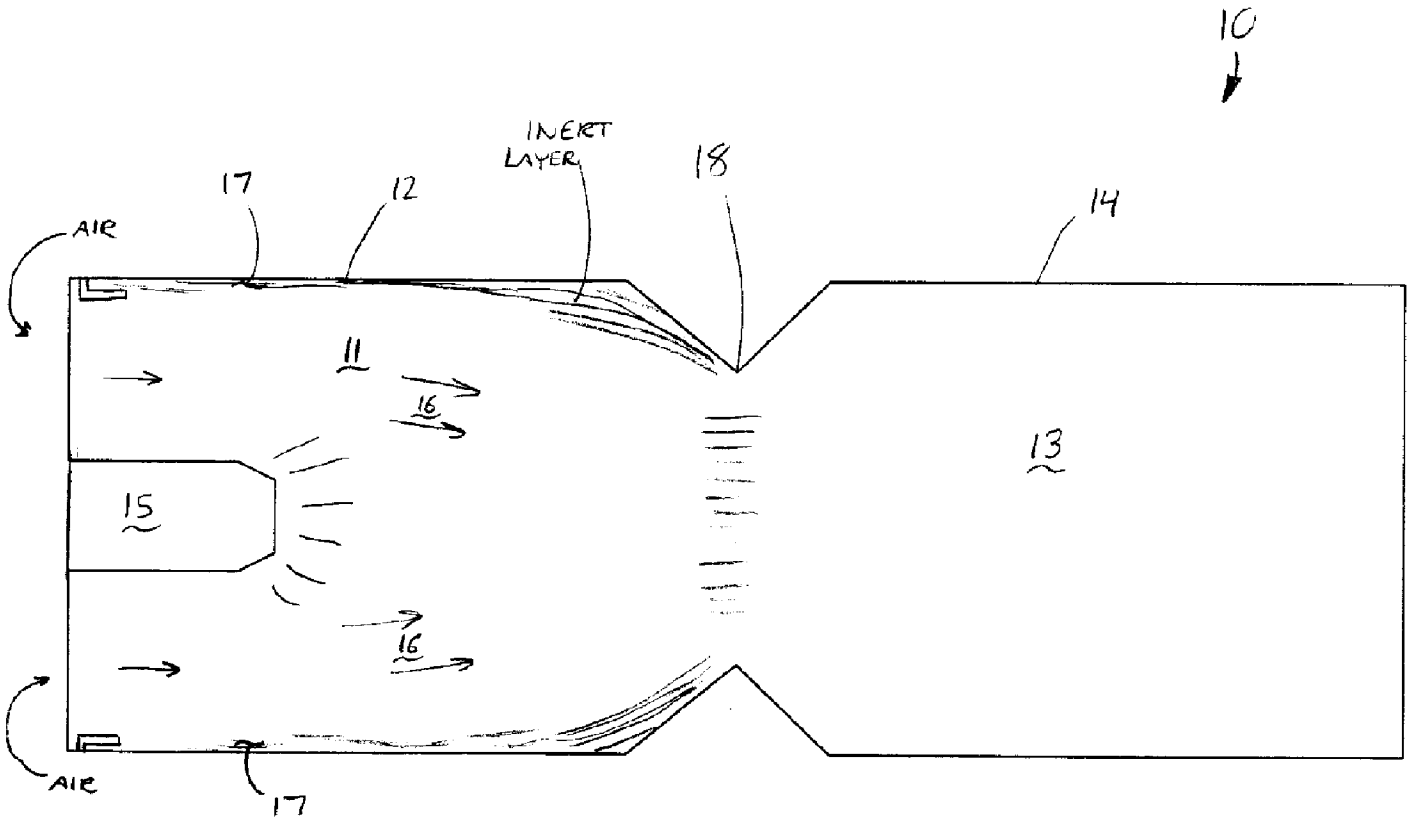
FIG. 1 is a cross section of a gas turbine combustor in accordance with the preferred embodiment of the present invention.

The present invention will now be described in detail with reference to FIGS. 1-3. Referring now to FIG. 1, the preferred embodiment of the present invention is shown in cross section. A gas turbine combustor 10 comprises premix chamber 11 having a first generally annular wall 12 and combustion chamber 13 having a second generally annular wall 14, with combustion chamber 13 in fluid communication with premix chamber 11.

Combustor 10 further comprises at least one fuel nozzle 15 for injecting a fuel into premix chamber 11 to form a mixture 16 with compressed air in premix chamber 11. For the purposes of a gas turbine engine, the compressed air is preferably delivered to combustor 10 from the engine compressor. As for the fuel type injected into the premix chamber, a variety of fuels can be used depending on fuel availability, operating conditions, and desired emissions levels. The fuel is preferably selected from the group comprising natural gas, liquid fuel, gas from coal gasification, synthetic fuels, fuels having high hydrogen levels, and fuels having high hydrocarbon levels.

While it is understood that premix combustors, in order to operate at extremely low emissions levels, must operate at lean fuel levels, a drawback to such operation is with respect to combustion instabilities, especially pressure fluctuations and flashback. Traditionally lean operating combustors are more susceptible to pressure fluctuations and flashback due to their flame instability caused by the low fuel content. Flames can flashback from the combustion chamber to the premix chamber by traveling up the boundary layer 17, which is located proximate first generally annular wall 12 and second generally annular wall 14, and has a lower flow velocity than fuel and air mixture 16. To prevent the flame from traveling from the combustion chamber to the premix chamber, boundary layer region 17 is purged with an inert gas, such as nitrogen. The inert gas is introduced into premix chamber 11 proximate first generally annular wall 12, as shown in FIG. 1, and is injected to ensure that no combustion reaction occurs in boundary layer 17. In this embodiment, the inert gas purges boundary layer 17 to prevent the flame in combustion chamber 13 from crossing venturi 18 and igniting in premix chamber 11.

Figure 2:
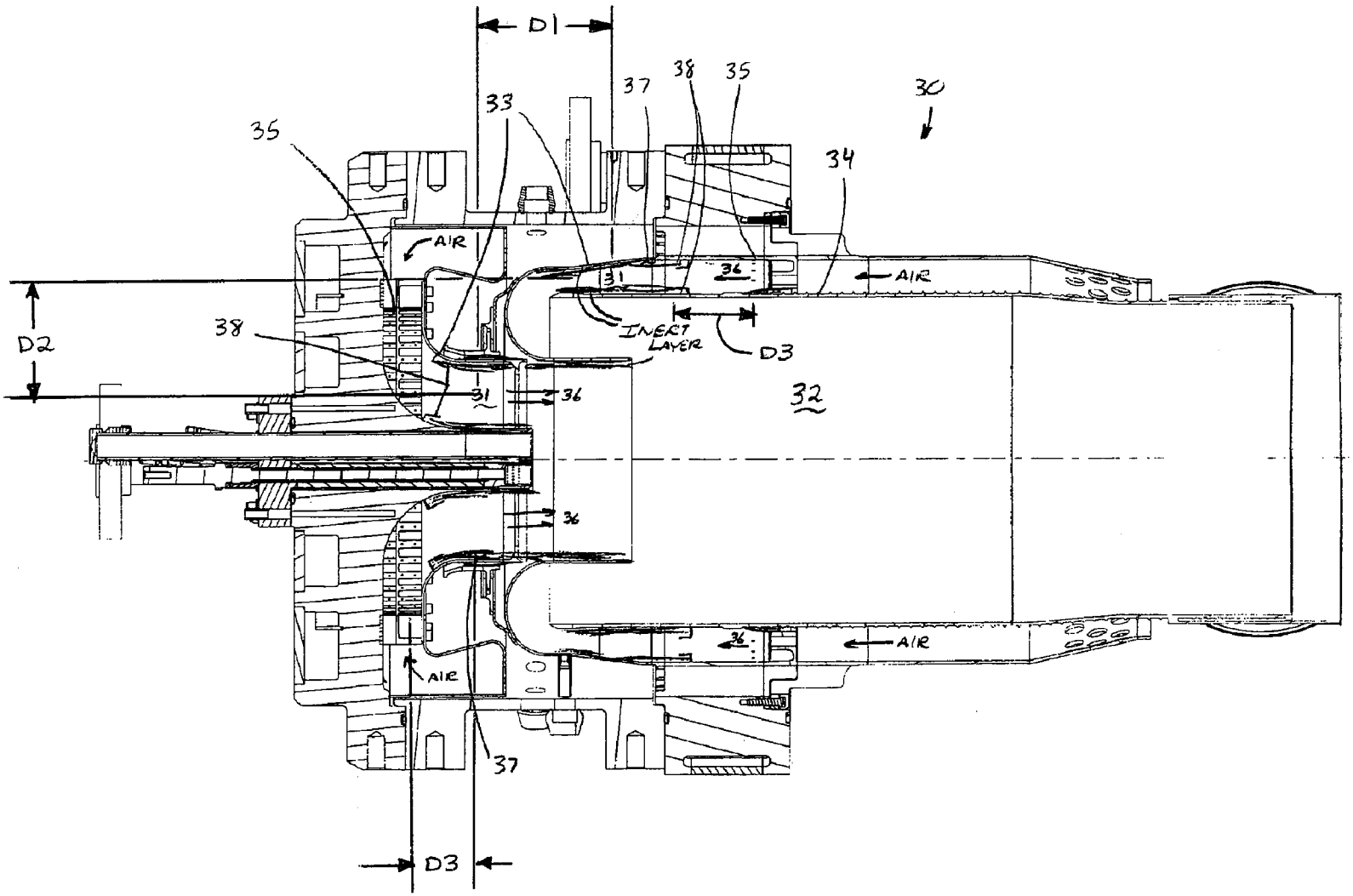
FIG. 2 is a cross section of a gas turbine combustor in accordance with a first alternate embodiment of the present invention.

A first alternate embodiment of the present invention is shown in cross section in FIG. 2. The primary differences between the first alternate embodiment and the preferred embodiment are with respect to the combustor itself. Combustor 30 in FIG. 2 does not utilize a venturi to separate premix chamber 31 from the combustion chamber 32. Instead, combustor 30 employs at least one, and in this specific embodiment, two different axially spaced premix chambers, the premix chambers 31 separated by an axial distance D1, and depending on the desired power output. The premix chambers 31 can also be spaced apart radially by a distance D2. Staging the premix chambers 31 in a radial direction provides a means to locate a plurality of premix chambers within a single combustion system. Each premix chamber 31 has a first generally annular wall 33 and combustion chamber 32 has a second generally annular wall 34, with combustion chamber 34 in fluid communication with premix chambers 31. At least one fuel nozzle 35 injects a fuel into premix chamber 31 to mix with compressed air, forming mixture 36 that passes into premix chamber 31. As described in the preferred embodiment, combustor 30 also comprises a boundary layer 37 located generally along first generally annular wall 33 and second generally annular wall 34. To increase the combustor flashback margin, as with the preferred embodiment, combustor 30 also comprises a means for injecting an inert gas 38 into boundary layer 37 of any combustible mixture 36 thereby ensuring no combustion reaction occurs in boundary layer 37. The means for injecting an inert gas 38 is spaced an axial distance D3 from the at least one fuel nozzle 35. Also, as with the preferred embodiment, the inert gas is preferably nitrogen and the fuel being injected into combustor 30 is selected from the group comprising natural gas, liquid fuel gas from coal gasification, synthetic fuels fuels having high hydrogen levels, and fuels having high hydrogen levels.

Figure 3:
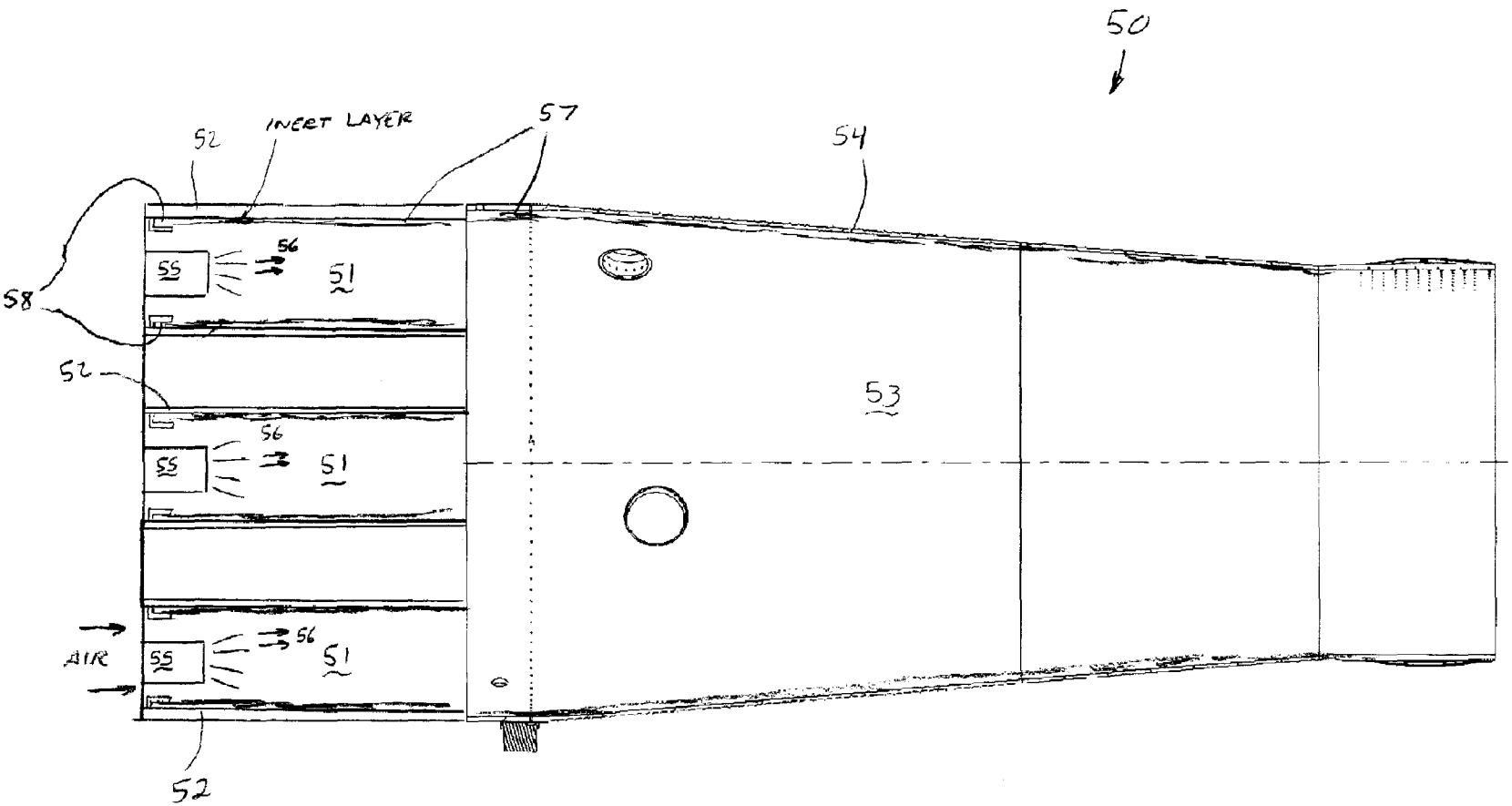
FIG. 3 is a cross section of a gas turbine combustor in accordance with a second alternate embodiment of the present invention.

Finally, a second alternate embodiment is shown in cross section in FIG. 3. This second alternate embodiment is very similar to the first alternate embodiment in that it also contains at least one premix chamber. However, in the second alternate embodiment, combustor 50 comprises a plurality of coaxial premix chambers 51, instead of axially staged premix chambers 31, as shown in FIG. 2. For the second alternate embodiment, at least one premix chamber 51 has a first generally annular wall 52. Combustor 50 further comprises combustion chamber 53 having second generally annular wall 54, where combustion chamber 53 is in fluid communication with at least one premix chamber 51. At least one fuel nozzle 55 is positioned to inject a fuel into at least one premix chamber 51 to form a mixture 56 with compressed air from an engine compressor. A boundary layer 57 is located in each premixer 51 and combustion chamber 53, generally along first generally annular wall 52 and second generally annular wall 54, respectively. To increase the combustor flashback margin, as with the preferred embodiment and first alternate embodiment, combustor 50 also comprises a means for injecting an inert gas 58 into boundary layer 57 to purge boundary layer 57 of any combustible mixture 56 thereby ensuring no combustion reaction occurs in boundary layer 57. Also, as with the preferred embodiment and first alternate embodiment, the inert gas is preferably nitrogen and the fuel being injected into combustor 50 is selected from the group comprising natural gas, liquid fuel, gas from coal gasification, synthetic fuels, fuels having high hydrogen levels, and fuels having high hydrocarbon levels. Furthermore, the exact axial location of inert gas injection within the boundary layer will depend on individual combustor geometry.

While the invention primarily pertains to the placement of an inert gas in the boundary layer of a gas turbine combustor, the means in which the inert gas is placed into the boundary layer is important as well. One skilled in the art of gas turbine combustion will understand that it is important to minimize any disruption to the overall premixer flowpath that would adversely affect combustor performance. Therefore, it is most desirable that the inert gas be injected into the boundary layer by way of openings in the first generally annular wall, such as through louvers and feed holes. It would be undesirable to place a plurality of inert gas injectors into the airflow entering the premixer and cause flow disturbances.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A gas turbine combustor having increased flashback margin, said combustor comprising:

a plurality of premix chambers spaced apart a distance both axially and radially, each premix chamber having a first generally annular wall;

a combustion chamber having a second generally annular wall, said combustion chamber in fluid communication with each of said premix chambers;

at least one fuel nozzle for injecting a fuel into each of said premix chambers to form a mixture with compressed air in each of said premix chambers;

a boundary layer located in each of said premix chambers and said combustion chamber generally along said first and second generally annular walls, said boundary layer containing said fuel and compressed air at a lower velocity than said mixture; and, a means for injecting an inert gas into said boundary layer for each of said plurality of premix chambers, said means for injecting located axially downstream with respect to a fluid flow direction from said at least one fuel nozzle, thereby ensuring that no combustion reaction occurs in said boundary layer.

2. The gas turbine combustor of claim 1 wherein said inert gas is nitrogen.

3. The gas turbine combustor of claim 1 wherein said fuel is selected from the group comprising natural gas, liquid fuel, gas from coal gasification, synthetic fuels, fuels having high hydrogen levels, and fuels having high hydrocarbon levels.

4. A gas turbine combustor comprising:

a plurality of premix chambers spaced a distance axially and radially apart, having a first generally annular wall;

a combustion chamber having a second generally annular wall, said combustion chamber in fluid communication with said one or more premix chambers;

a plurality of fuel nozzles capable of injecting a fuel into said plurality of premix chambers to form a mixture with compressed air in said plurality of premix chambers;

a boundary layer region located in at least said one or more premix chambers generally along said first generally annular wall, said boundary layer containing said fuel and compressed air at a lower velocity than said mixture; and, a plurality of injection sources for injecting an inert gas into said boundary layer for each of said plurality of premix chambers, each of said plurality of injection means located axially downstream with respect to a fluid flow direction from said at least one fuel nozzle, so as to prevent a combustion reaction in said boundary layer.

5. The gas turbine combustor of claim 4, wherein said fuel is injected into said one or more premix chambers before said inert gas is injected into said one or more premix chambers.

6. The gas turbine combustor of claim 5, wherein said fuel is selected from the group comprising natural gas, liquid fuel, gas from coal gasification, synthetic fuels, fuels having high hydrogen levels, and fuels having high hydrocarbon levels.

* * * * *